US007397564B2

(12) United States Patent
Diez Garcia et al.

(10) Patent No.: US 7,397,564 B2
(45) Date of Patent: Jul. 8, 2008

(54) TURBIDITY SENSOR

(75) Inventors: Sergio Diez Garcia, Obanos Navarra (ES); Andres Ochoa Miquelez, Mendavia (ES)

(73) Assignee: Zertan, S.A. (ES)

( * ) Notice: Subject to any disclaimer, the term of this patent is extended or adjusted under 35 U.S.C. 154(b) by 0 days.

(21) Appl. No.: 10/596,523

(22) PCT Filed: Dec. 17, 2004

(86) PCT No.: PCT/ES2004/000559

§ 371 (c)(1),
(2), (4) Date: Sep. 28, 2006

(87) PCT Pub. No.: WO2005/061775

PCT Pub. Date: Jul. 7, 2005

(65) Prior Publication Data

US 2007/0214873 A1 Sep. 20, 2007

(30) Foreign Application Priority Data

Dec. 18, 2003 (ES) ..... 200302909 U

(51) Int. Cl.
*G01N 21/00* (2006.01)
*G01N 21/05* (2006.01)

(52) U.S. Cl. ..... 356/440; 356/338; 250/343

(58) Field of Classification Search ..... 356/432–444, 356/338–340; 250/336, 341, 343, 357, 338
See application file for complete search history.

(56) References Cited

U.S. PATENT DOCUMENTS

| | | | | | |
|---|---|---|---|---|---|
| 4,962,395 | A * | 10/1990 | Baird | ..... | 340/619 |
| 5,172,332 | A * | 12/1992 | Hungerford et al. | ..... | 700/267 |
| 5,444,531 | A * | 8/1995 | Foreman et al. | ..... | 356/341 |
| 5,446,544 | A * | 8/1995 | Beers | ..... | 356/339 |
| 6,842,243 | B2 * | 1/2005 | Tokhtuev et al. | ..... | 356/338 |
| 7,142,299 | B2 * | 11/2006 | Tokhtuev et al. | ..... | 356/338 |
| 2003/0214653 | A1 * | 11/2003 | Palumbo et al. | ..... | 356/338 |

* cited by examiner

*Primary Examiner*—Sang Nguyen
(74) *Attorney, Agent, or Firm*—Lucas & Mercanti, LLP

(57) ABSTRACT

The invention relates to a turbidity sensor comprising an operational assembly which is housed in a structure (1) and which is equipped with a support (3) having a base (5) from which pins (6) extend. According to the invention, the components (7 and 8) of a turbidity sensor are incorporated in the aforementioned pins (6). The cables of said components passing through the pins to a printed circuit (4), In addition, a temperature sensor element (14) is incorporated in another pin (6.1) which also extends from the base (5).

3 Claims, 6 Drawing Sheets

TURBIDITY SENSOR

FIELD OF THE INVENTION

The present invention relates to the measuring of variables such as the transparency, temperature and conductivity of a fluid, such as the water used in household appliances of the type such as washing machines, dishwashers etc., proposing a device which allows controlling said variables by means of a very practical and advantageous embodiment.

STATE OF THE ART

In household appliances of the type such as dishwashers, washing machines, etc., control of certain variables of the water used is essential to obtain suitable automatic control of the operation.

In this sense, for example, control of the transparency, temperature and conductivity of the water is of interest so as to establish different functions of the operating behavior of the apparatus of application, there being devices which allow the measurement of such variables in an independent manner, which is difficult to assemble and expensive to install.

To solve this drawback, devices have been developed which have in a common assembly components of the measurement or detection of variables such as turbidity and temperature.

In this sense different solutions exist, such as those of Patent EP 0 748 891 with priority date Jun. 12, 1995 or that of PCT WO 96/21390 with priority date Jan. 10, 1995 which refer to devices including turbidity and temperature measuring means related to each other.

Another known solution is that of Spanish Utility Model No. 9801453 with application date Jun. 4, 1998, describing a device bringing together a turbidity measuring device and a temperature measuring device, comprising a casing structure which determines two hollow projections in which the elements of said measuring elements are housed.

The solution of Patent EP 1335060 with application date Jan. 31, 2002 is also known where a device is described which includes both a turbidity sensor and a temperature sensor, housed in a structure which in turn determines two hollow projections being of different lengths in this case, the elements of the turbidity sensor being housed in one of them, whereas the other element of the turbidity sensor and the temperature sensor are housed and suitably insulated in the other one.

OBJECT OF THE INVENTION

In accordance with the invention a device is proposed for the measuring of variables such as the turbidity, temperature and conductivity of a fluid, such as the water used in household appliances of the type such as washing machines, dishwashers, etc., by means of an embodiment having highly advantageous constructive and operational features.

This device object of the invention consists of a structure closed by a cover, determining a housing in which there is included the combined operational assembly made up of a printed circuit and the electronic elements intended for measuring the variables of application, the entire operational assembly being arranged in a one-piece support of insulating material which determines a base provided with couplings for fastening the printed circuit and from which pins exit which determine slots for the fastening of the electronic measurement instruments, as well as guides for housing the connecting cables of said elements.

The support of the operational assembly determines two pins, in which the respective component elements of a turbidity sensor and the corresponding connecting cables are incorporated. The base of the support also determines formations allowing the fastening of the printed circuit by means of a clipped coupling of the plate thereof, with the possibility of being disassembled. The elements of the operational assembly are thus safely housed in the device, whereas the arrangement of the cables inside the guides determined by the pins of support, in turn ensures the fastening and protection of said cables so as to properly maintain their connections.

In an embodiment the support determines three pins, two of which being intended for the incorporation of the component elements of a turbidity sensor and the third intended for incorporating a temperature sensor, there being provided in relation to this support a structure of the device built with three hollow projections, so as to house therein the respective pins of the support with the elements of the operational assembly they incorporate, so that the projections of the housing of the components of the turbidity sensor are of one length, whereas the projection of the housing of the temperature sensor is of less length than the former.

Two electrodes intended for measuring the conductivity of the application means can also be incorporated in relation to the operational assembly, which electrodes are arranged such that they exit to the outside through sealed passages, being incorporated through the projections of the structure in which the components of the turbidity sensor are housed, which projections are determined in this case with a notch in the end part in which the corresponding electrode projects.

The cover of the structure of the device determines on its edge formations corresponding and complementary with other reciprocal formations determining the structure, defining between the two exit passages of the connecting cables to the outside; while the fastening of the cover is established by means of rods of the structure exiting through the openings of the cover and which are riveted by heat-swaging on the outer part.

With all the above, a turbidity sensor device is obtained which can be combined with a temperature sensor and/or a conductivity sensor, the operational assembly being housed in a closed structure determining two equal hollow projections in which there are included the elements of the turbidity sensor together with the elements of the conductivity sensor in its case, whereas in the case of the temperature sensor it includes a third hollow projection of the structure being of a different length from the former.

With this embodiment of the device set forth, very considerable advantages with respect to known solutions are obtained in terms of its constructive and operational features, such as:

- Easy panelization of the printed circuit and the possibility of carrying this out on one side only, in which translates into an advantageous saving of material, being able to use more cost-efficient material.
- The location of the temperature sensor in a separate individual housing prevents the effect of heat dissipation of the elements of the turbidity sensor and also facilitates assembly.
- The fixing of the closing cover of the structure with heat-swaged rivets prevents the opening and incorrect handling of the operational assembly.

Therefore, said device object of the invention results from specific features providing it with a life of its own and a preferred character with respect to the devices currently known for similar applications.

DETAILED DESCRIPTION OF THE INVENTION

Figure 1:
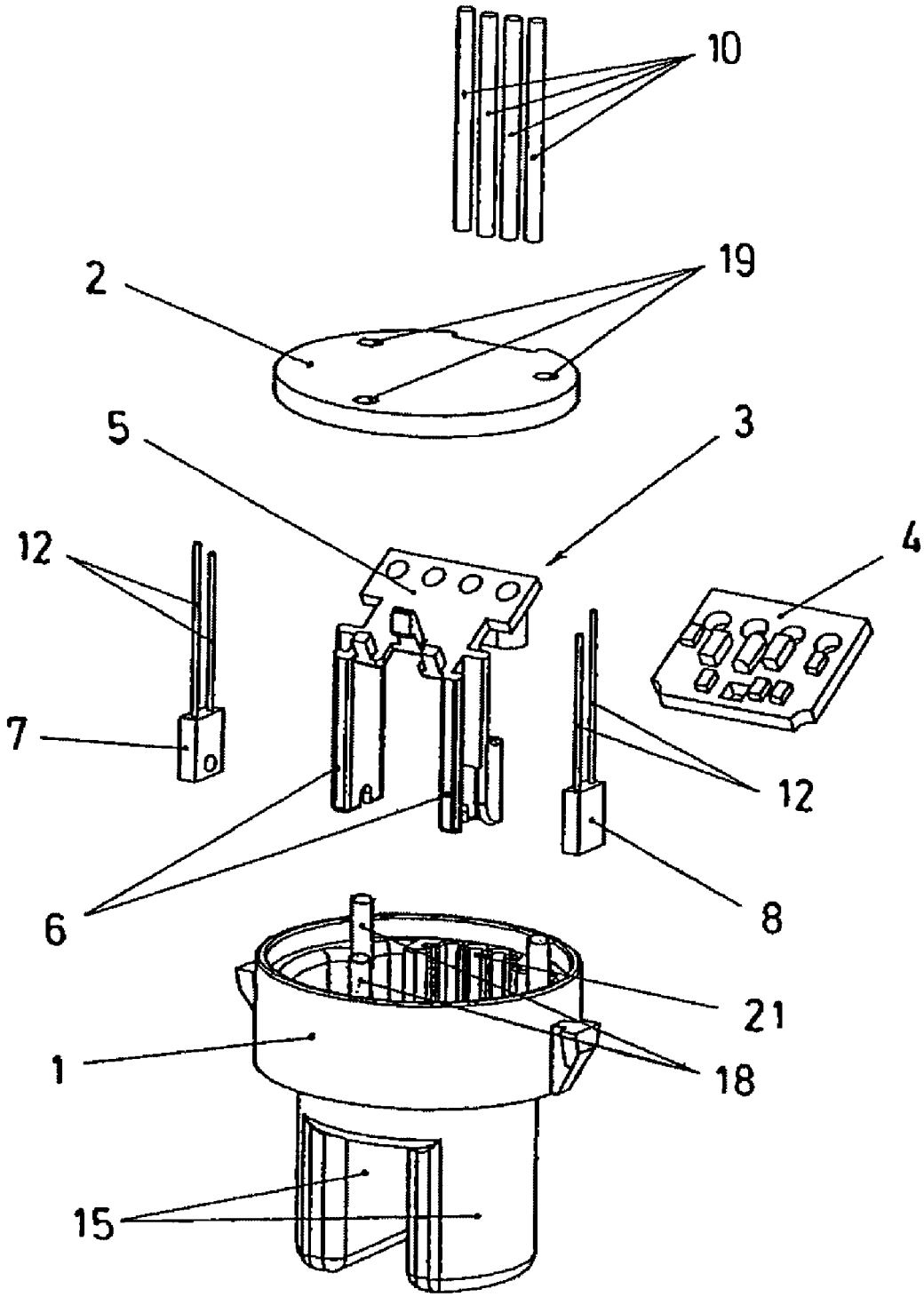
FIG. 1 shows an exploded perspective view of the assembly of a turbidity sensor according to the invention.

The object of the invention comprises a device intended for measuring variables such as the turbidity, temperature and conductivity of a fluid, such as the water used in household appliances of the type such as washing machines, dishwashers, etc., incorporating all the elements for said functions in a single assembly.

Said device is made up of a structure (1) of insulating material, preferably transparent, which is closed with a cover (2), determining a housing in which an operational assembly is included comprising a support (3) on which a printed circuit (4) and the electronic elements for carrying out the application functions are incorporated.

The support (3) has a base (5) from which two pins (6) integral with it extend, formed as guides and which determine a slot at the end for the fastening of the respective components (7 and 8) of a turbidity sensor, the base (5) having openings (9) for the passage of the connecting cables (10) to the outside from a terminal strip (11) associated to the base (5), while the connecting cables (12) of the components (7 and 8) are housed throughout the guides defined by the pins (6), thus being protected in the arrangement of the assembly in its extension to the connection with the printed circuit (4).

The base (5) further determines coupling formations (13) by means of which the printed circuit (4) is fastened by clipping on said base (5) with the possibility of being disassembled.

Figure 2:
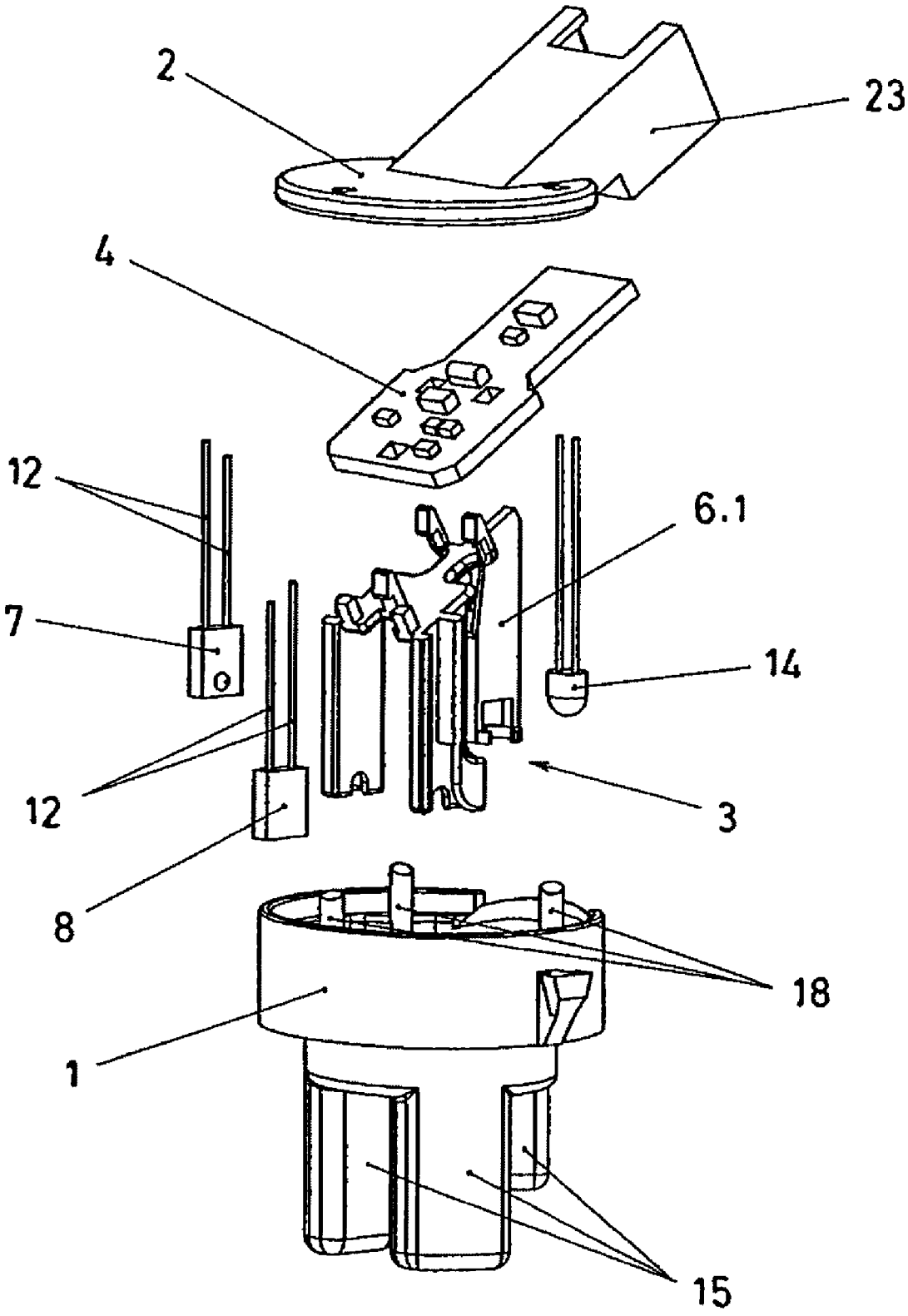
FIG. 2 shows an exploded perspective view of an embodiment of the turbidity sensor together with a temperature sensor.
Figure 8:
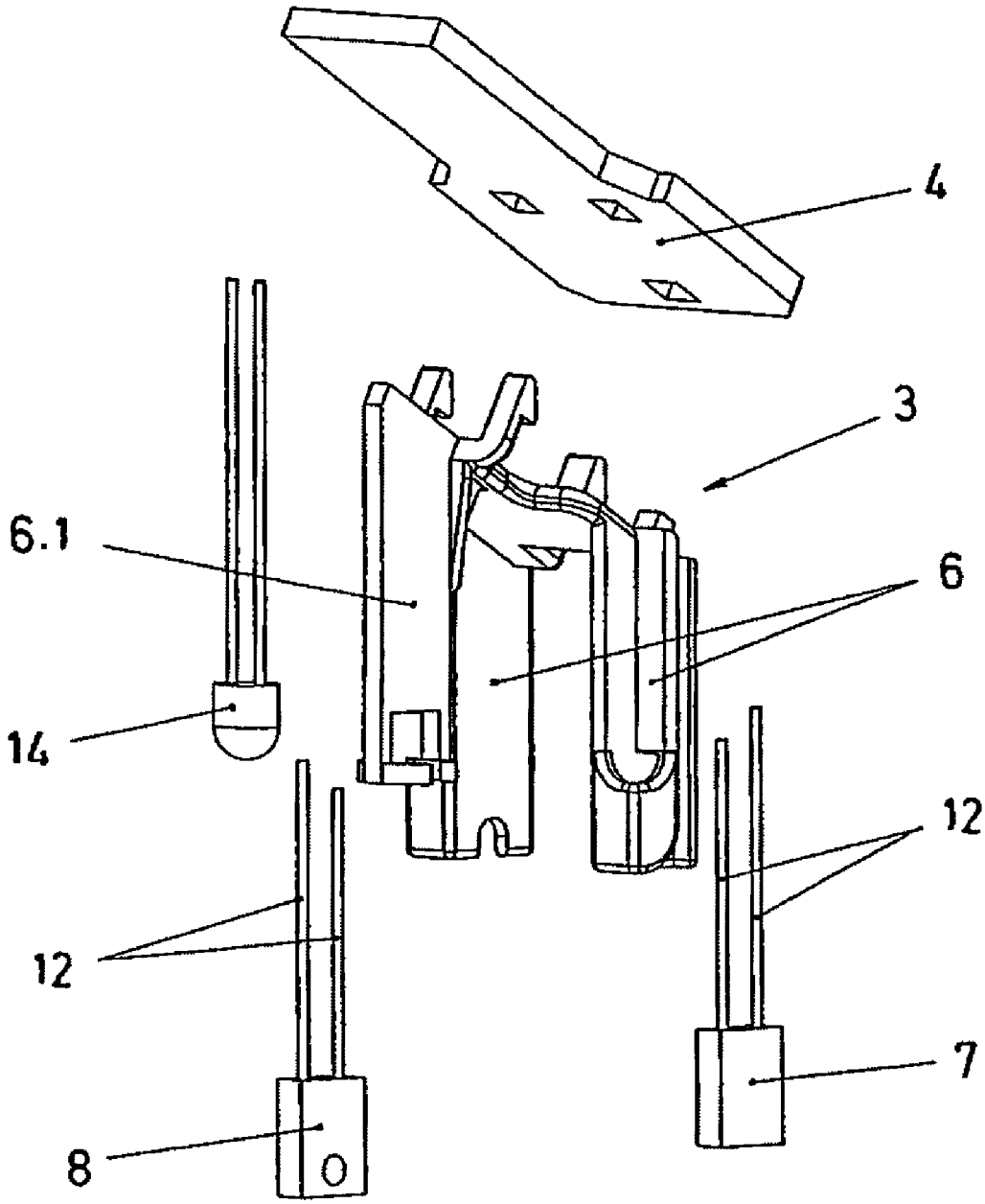
FIG. 8 shows an exploded perspective view of the assembly of the fastening support of the components of a turbidity sensor and a temperature sensor, with the respective elements of said sensors in a correlative assembly position.

The support (3) can determine in its own one-piece structural assembly a third pin (6.1), defining therein a corresponding slot for the fastening of a temperature sensor (14), such as an NTC resistor, according to FIGS. 2 and 8, it being provided that said third pin (6.1) is of less length than pins (6), so that the element (14) is not opposite to components (7 and 8) of the turbidity sensor.

In relation with the arrangement of the operational assembly on the support (3), the structure (1) of the device determines hollow projections (15) in which there are housed the pins (6 and 6.1) with the respective elements (7, 8 and 14) responsible for carrying out the application functions, such that the pin (6) of the support (3) having the component element (7) of the turbidity sensor is housed in one of the projections (15), the pin (6) having the component element (8) of the turbidity sensor is housed in another one and the pin (6.1) having the temperature sensor element (14) is housed in the third projection (15), this third projection (15) being of less length than the other two, in the same manner as that of the relation between pins (6) and pin (6.1) of the support (3).

Figure 5:
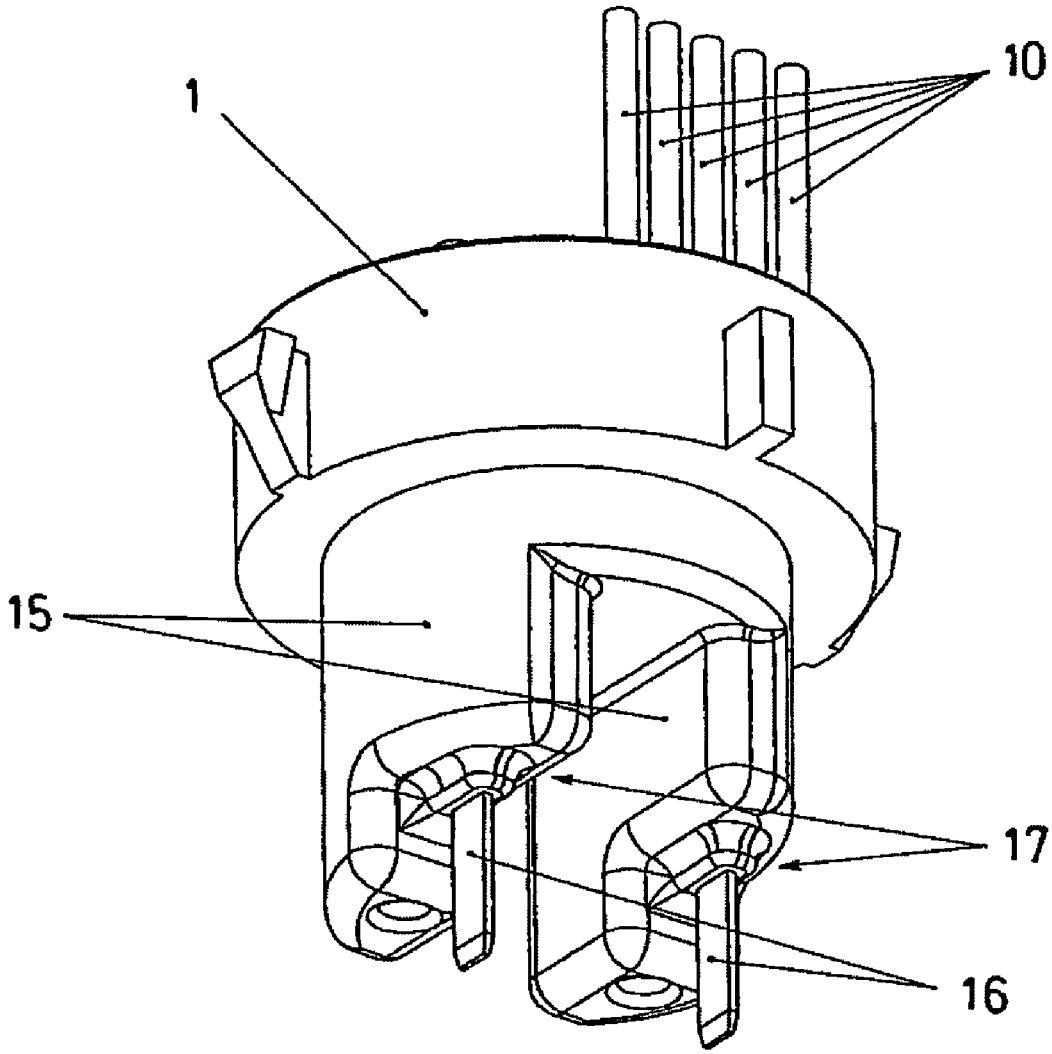
FIG. 5 shows a perspective view of an embodiment of the turbidity sensor together with a conductivity sensor.
Figure 6:
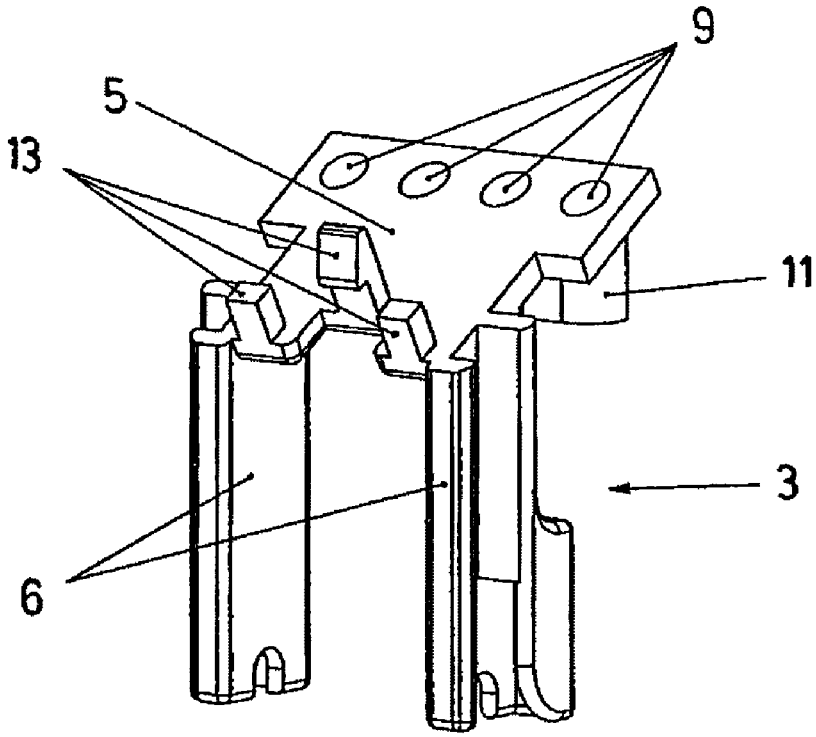
FIG. 6 shows a perspective view of the assembly support of the components of the turbidity sensor in the device set forth.
Figure 7:
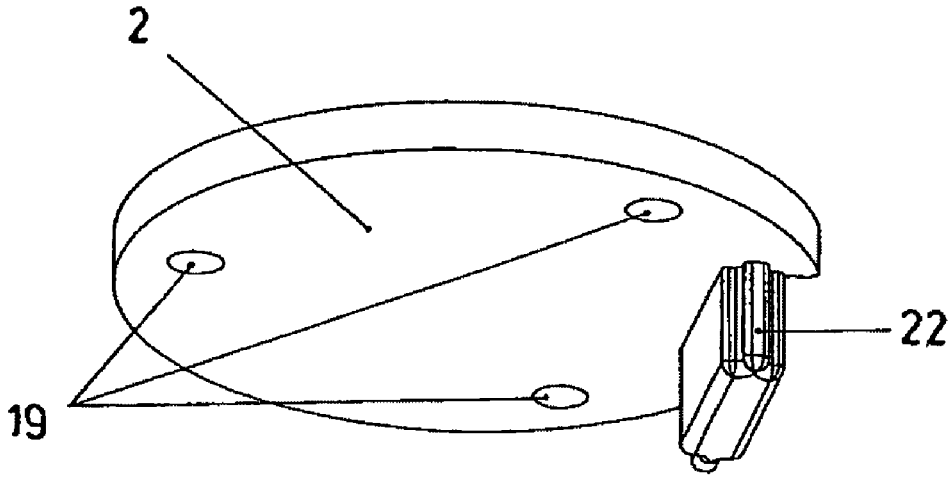
FIG. 7 shows a perspective view of the closing cover of the device seen from the lower part.

In relation to the operational assembly, two electrodes can also be incorporated (16), which are arranged connected in turn to the printed circuit (4) and exiting to the outside through sealed passages so as to carry out the function of measurement of the conductivity of the application means; it being provided that said electrodes (16) are respectively parallel in relation to the pins (6) of the support (3), being included inside the corresponding hollow projections (15) housing said pins (6), which (15) determine in this case a notch (17) on the end part in which the respective electrodes (16) project, as can be seen in FIG. 5.

Figure 3:
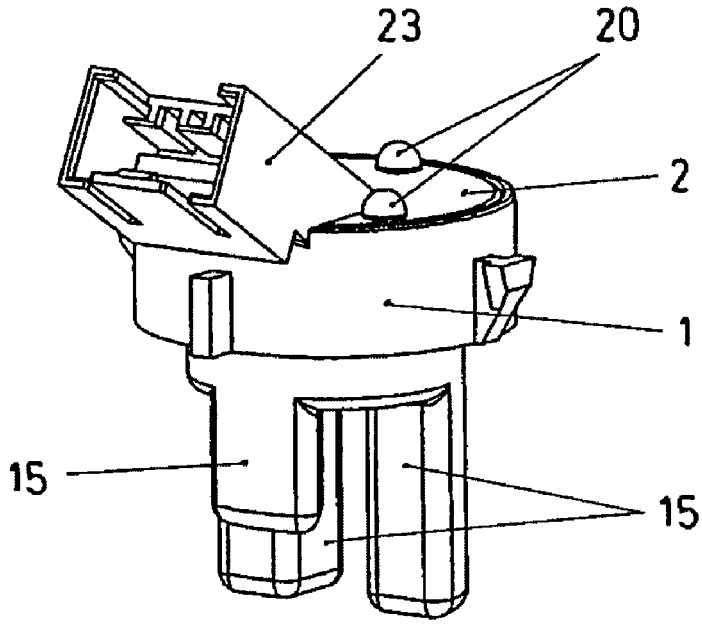
FIG. 3 shows a perspective view of the assembly of the previous figure assembled seen from the upper part.

The fastening of the cover (2) in its assembly on the structure (1) is carried out by means of rods (18) of the same material as the structure (1), which pass through openings (19) of the cover (2) for the riveting (20) thereof by means of heat-swaging on the outside, as illustrated in FIG. 3.

The structure (1) further determines some grooved formations (21) in an area of its inner contour, in correspondence with which the cover (2) determines a block (22) of reciprocal formations in its periphery, defining between the two assemblies of formations (21 and 22), when the cover (2) is incorporated in its mounting, passage ducts for the connecting cables (10) to pass to the outside, said cables being clamped and fastened between the afore-mentioned formations (21 and 22), such that the retention thereof is perfectly secured.

Figure 4:
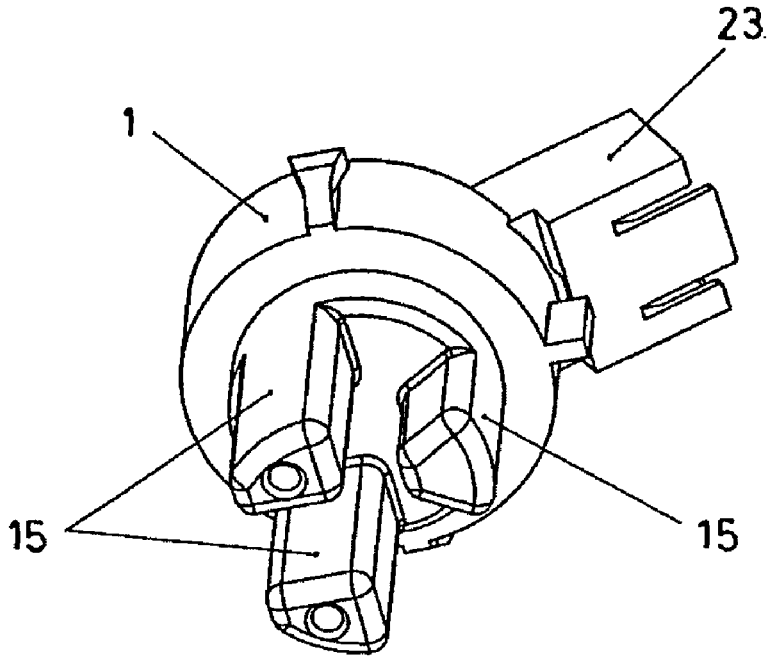
FIG. 4 shows a perspective view of the same assembly of the previous figure seen from the lower part.

In this arrangement, the cables (10) can extend freely on the outside to be connected where desired, according to FIGS. 1 and 5, or they can end in a connector (23) associated to the cover (2), according to FIGS. 2, 3 and 4. Therefore, in the case of the connector (23) integrated on the cover (2), said connector (23) is provided in a lateral arrangement, bent 30°, which allows simplicity for the connection and disconnection, with the possibility of assembly according to any orientation within 360° for facilitating the connection without interference with other parts.

The invention claimed is:

1. A turbidity sensor comprising a structure internally housing an operational assembly capable of measuring different variables of a liquid application medium, wherein the operational assembly is arranged on a support comprising a base, from which pins integral with it extend, formed as guides and having a slot at the end with respect to which the respective components of the turbidity sensor can be incorporated, the connecting cables of which are housed in the guides defined by said pins in the extension to a printed circuit incorporated on the base whereas a temperature sensor element can be incorporated in the other pin also integral with the base, wherein the structure is closed with a cover which is fastened by means of rods of the material of the structure, which rods exit through openings of the cover to establish heat-swaged riveting on the outside, said cover determining on the periphery a block of the corresponding reciprocal formations with grooved formations of the inner periphery of the structure among which they define exit passages and the gripping of the connecting cables to the outside.

2. A turbidity sensor comprising a structure internally housing an operational assembly capable of measuring different variables of a liquid application medium, wherein the operational assembly is arranged on a support comprising a base, from which pins integral with it extend, formed as guides and having a slot at the end with respect to which the respective components of the turbidity sensor can be incorporated, the connecting cables of which are housed in the guides defined by said pins in the extension to a printed circuit incorporated on the base whereas a temperature sensor element can be incorporated in the other pin also integral with the base, wherein in relation to the support the structure determines three hollow projections in which the pins of the support are housed, respectively, with the corresponding elements of the operational assembly incorporated therein, one of which projections is of less length than the other two, that is, the pin of the support is shorter than pins.

3. A turbidity sensor comprising a structure internally housing an operational assembly capable of measuring different variables of a liquid application medium, wherein the operational assembly is arranged on a support comprising a base, from which pins integral with it extend, formed as guides and having a slot at the end with respect to which the respective components of the turbidity sensor can be incorporated, the connecting cables of which are housed in the guides defined by said pins in the extension to a printed circuit incorporated on the base whereas a temperature sensor element can be incorporated in the other pin also integral with the base, wherein in relation to the operational assembly, two electrodes can be incorporated, which are arranged correlatively parallel to the respective pins of the support being included throughout the hollow projections of the structure housing said pins which hollow projections determine in this case an end notch, in which the corresponding electrode exits to the outside through a sealed passage.

* * * * *